US010206855B2

(12) United States Patent
Reed et al.

(10) Patent No.: US 10,206,855 B2
(45) Date of Patent: Feb. 19, 2019

(54) BOTTLE ASSEMBLY VENT INSERT WITH SIPHONING MEMBER

(71) Applicant: HANDI-CRAFT COMPANY, St. Louis, MO (US)

(72) Inventors: Mark D. Reed, Columbia, IL (US); Bernard J. Kemper, Bonne Terre, MO (US)

(73) Assignee: Handi-Craft Company, St. Louis, MO (US)

( * ) Notice: Subject to any disclaimer, the term of this patent is extended or adjusted under 35 U.S.C. 154(b) by 0 days.

(21) Appl. No.: 15/663,324

(22) Filed: Jul. 28, 2017

(65) Prior Publication Data

US 2018/0042818 A1 Feb. 15, 2018

Related U.S. Application Data

(60) Provisional application No. 62/372,850, filed on Aug. 10, 2016.

(51) Int. Cl.

| | |
|---|---|
| ***A61J 11/02*** | (2006.01) |
| ***A61J 9/04*** | (2006.01) |
| ***A61J 9/06*** | (2006.01) |
| ***A61J 9/00*** | (2006.01) |
| ***A61J 9/08*** | (2006.01) |
| ***A61J 11/04*** | (2006.01) |

(52) U.S. Cl.

CPC ..... *A61J 9/04* (2013.01); *A61J 9/006* (2013.01); *A61J 9/0623* (2015.05); *A61J 9/085* (2013.01); *A61J 11/02* (2013.01); *A61J 11/045* (2013.01)

(58) Field of Classification Search

CPC ..... A61J 11/07; A61J 9/04; A61J 11/02
USPC ..... 215/11, 11.5
See application file for complete search history.

(56) References Cited

U.S. PATENT DOCUMENTS

| | | | | |
|---|---|---|---|---|
| 3,411,648 | A | 11/1968 | Tichy | |
| 8,684,201 | B2 * | 4/2014 | Berkovitch | A61J 9/04 215/11.4 |
| 2004/0089626 | A1 | 5/2004 | Pyun | |
| 2005/0236353 | A1 * | 10/2005 | Hsu | A61J 9/006 215/11.5 |
| 2008/0217282 | A1 * | 9/2008 | Brown | A61J 9/006 215/11.5 |
| 2009/0200257 | A1 | 8/2009 | McKendry et al. | |
| 2010/0038335 | A1 * | 2/2010 | Liang | 215/11.5 |
| 2011/0309047 | A1 | 12/2011 | Fucito | |

(Continued)

*Primary Examiner* — Sue A Weaver
(74) *Attorney, Agent, or Firm* — Armstrong Teasdale LLP

(57) ABSTRACT

A feeding assembly includes a container having an open top and defining a liquid chamber therein for holding a liquid. A collar assembly defines a closure for the open top of the container upon assembly with the container. A vent assembly is positionable at least in part on the open top of the container and is configured to facilitate venting of the container to atmosphere as liquid exits the feeding assembly during feeding. The vent assembly being disposed intermediate the container and the nipple, has at least one opening through which liquid is able to flow from the container to the nipple during feeding. The vent assembly has a siphon member extending longitudinally of the feeding assembly and generally away from the nipple and is configured to facilitate the flow of liquid from the nipple back into the container when feeding is ceased and the container is oriented generally upright.

17 Claims, 14 Drawing Sheets

(56) References Cited

U.S. PATENT DOCUMENTS

| | | | |
|---|---|---|---|
| 2016/0106628 | A1 | 4/2016 | Kemper et al. |
| 2016/0213573 | A1 | 7/2016 | Rosskamm |

* cited by examiner

BOTTLE ASSEMBLY VENT INSERT WITH SIPHONING MEMBER

CROSS-REFERENCE TO RELATED APPLICATION

This patent application claims priority to U.S. Provisional Patent Application Ser. No. 62/372,850 filed Aug. 10, 2016, which is hereby incorporated by reference in its entirety.

FIELD

The field of this invention relates generally to bottle assemblies and more particularly to a vent insert for a bottle assembly including a siphoning member.

BACKGROUND

Bottle assemblies, such as infant or nursing bottle assemblies, typically have multiple components including a bottle, a nipple, a collar for securing the nipple to the bottle (the nipple and collar sometimes collectively defining a collar assembly), and a cap for covering the nipple when the bottle is not in use. The nipple typically has one or more openings for allowing liquid contained within the bottle to exit through the nipple and into an infant's mouth for consumption by the infant (or young child). During use, the infant places an end of the nipple in their mouth and sucks on the nipple to withdraw the liquid contained within the bottle.

At least some bottle assemblies include a removable vent assembly that can be positioned within the bottle. For example, at least some bottle assemblies comprise a removable vent assembly configured to sit on an annular rim defining an open end of the bottle which permits venting of the bottle during use. In these bottle assemblies, the vent assembly allows air to enter the bottle while the infant consumes the liquid through the nipple, thus alleviating or reducing the formation of a vacuum within the bottle during nursing. The vent assembly typically seats, at least in part, on the rim of the bottle and a collar assembly including a collar and nipple are together threadably secured down over the vent assembly to external threads on the neck of the bottle.

The vent assemblies, therefore, are positioned between the bottle and the nipple, and include an air vent feature for venting air from the interior of the bottle to the ambient environment exterior of the bottle assembly. The vent assembly includes one or more openings through which the liquid contents of the bottle can flow through the vent assembly to the nipple for consumption by the infant. In use, the bottle assembly is typically tilted at a downward angle so that the contents of the bottle flow through the openings of the vent assembly into the nipple. When feeding is complete, the bottle is tilted back upright. As such, liquid remaining in the nipple is intended to flow back through the openings of the vent assembly and back into the bottle. In view of the number, size and/or shape of the openings in the vent assembly, the liquid may not always properly flow back through the openings, e.g., instead forming a meniscus within the openings and inhibiting flow back. As a result, the risk of leakage from the bottle assembly is increased.

There is a need, therefore, for a bottle assembly, and in particular a vented bottle assembly, in which the vent assembly facilitates the flow back of liquid into the bottle when the bottle is turned upright after feeding.

SUMMARY

In one aspect, a feeding assembly generally comprises a container having an open top and defining a liquid chamber therein for holding a liquid. A collar assembly defines a closure for the open top of the container upon assembly with the container. The collar assembly includes a collar releasably securable to the container and a nipple coupled to the collar and having an opening through which liquid exits the feeding assembly during feeding. A vent assembly is positionable at least in part on the open top of the container and is configured to facilitate venting of the container to atmosphere as liquid exits the feeding assembly during feeding. The vent assembly is disposed intermediate the container and the nipple and has at least one opening through which liquid is able to flow from the container to the nipple during feeding. The vent assembly has a siphon member extending longitudinally of the feeding assembly and generally away from the nipple and is configured to facilitate the flow of liquid from the nipple back into the container when feeding is ceased and the container is oriented generally upright.

BRIEF DESCRIPTION OF THE DRAWINGS

These and other features, aspects, and advantages of the present disclosure will become better understood when the following detailed description is read with reference to the accompanying drawings in which corresponding characters represent corresponding parts throughout the several views of the drawings.

Figure 1:
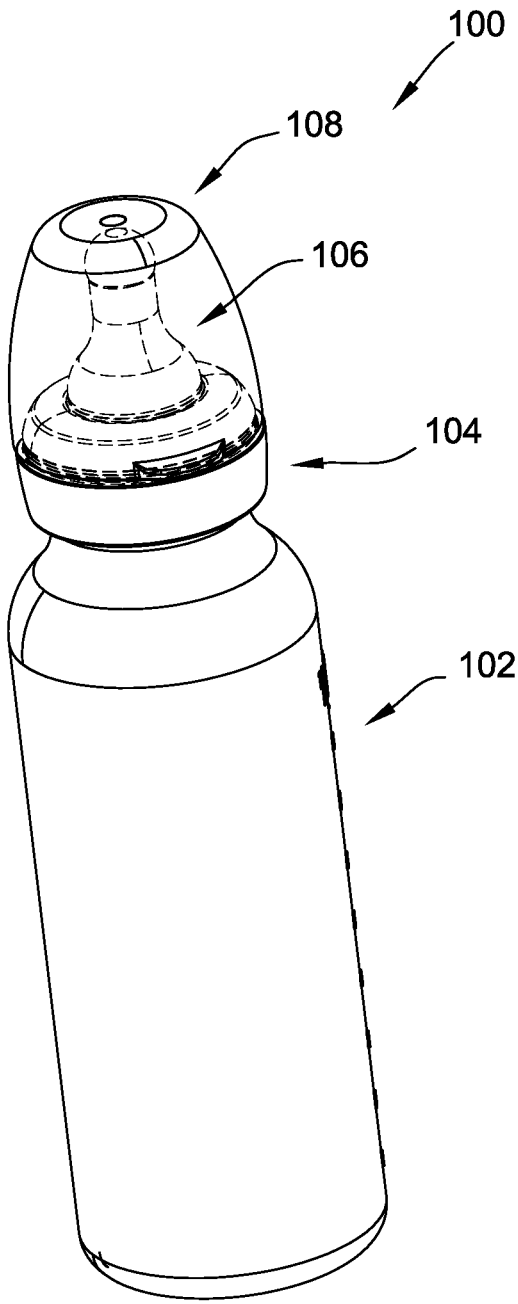
FIG. 1 is a perspective of one embodiment of a nursing bottle assembly.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION OF THE DRAWINGS

In the following specification and the claims, reference will be made to a number of terms, which shall be defined to have the following meanings.

In the following specification and the claims, reference will be made to a number of terms, which shall be defined to have the following meanings. The singular forms "a," "an," and "the" include plural references unless the context clearly dictates otherwise. The terms "comprising," "including," and "having" are intended to be inclusive and mean that there may be additional elements other than the listed elements. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise Referring now to the drawings and in particular to FIGS. 1-3, a bottle assembly including a vent assembly is indicated generally at 100. The bottle assembly 100 includes a bottle or container 102, a collar 104, a nipple 106, and a cover 108. Each one of the bottle 102, collar 104, nipple 106, and cover 108 are indicated generally by their respective reference number. As described with reference to FIGS. 2 and 3, the bottle 102 has a closed bottom 110, an open top 112, and a generally cylindrical sidewall 114 extending between the closed bottom 110 and the open top 112. The generally cylindrical sidewall 114 includes a base portion 116, a top threaded portion 118, a middle portion 120, and an upper portion 122. The middle portion 120 extends between the base portion 116 and the upper portion 122.

Figure 2:
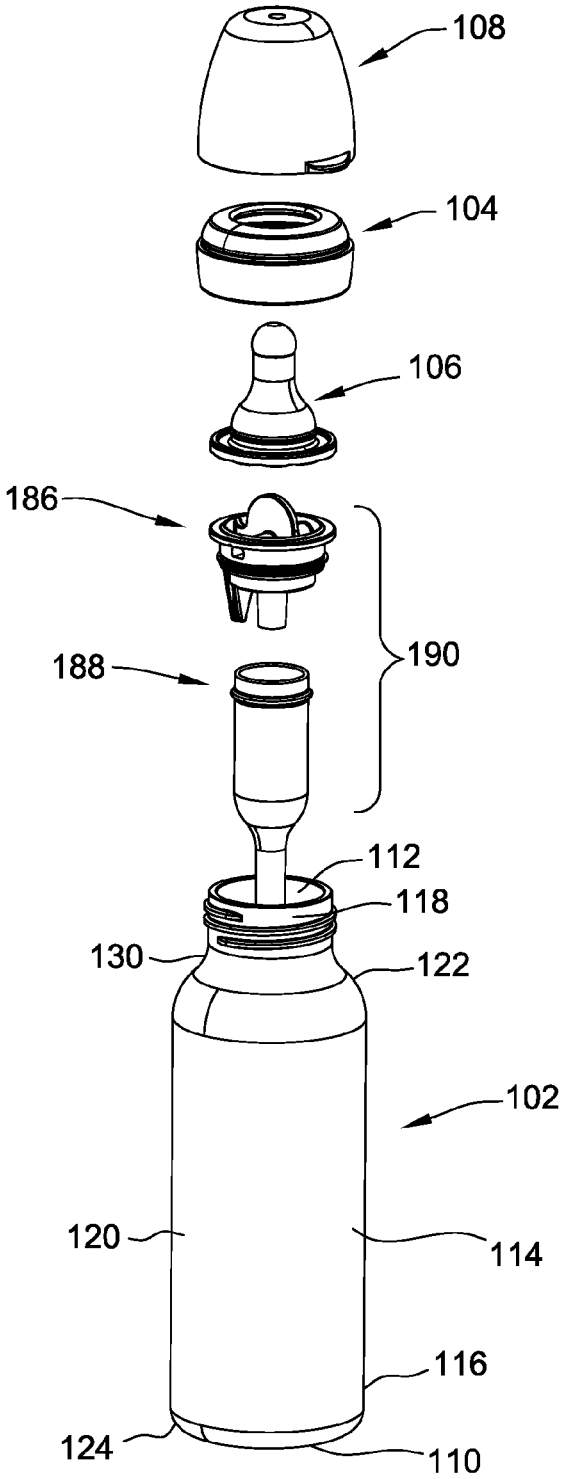
FIG. 2 is an exploded perspective of the bottle assembly shown in FIG. 1.
Figure 3:
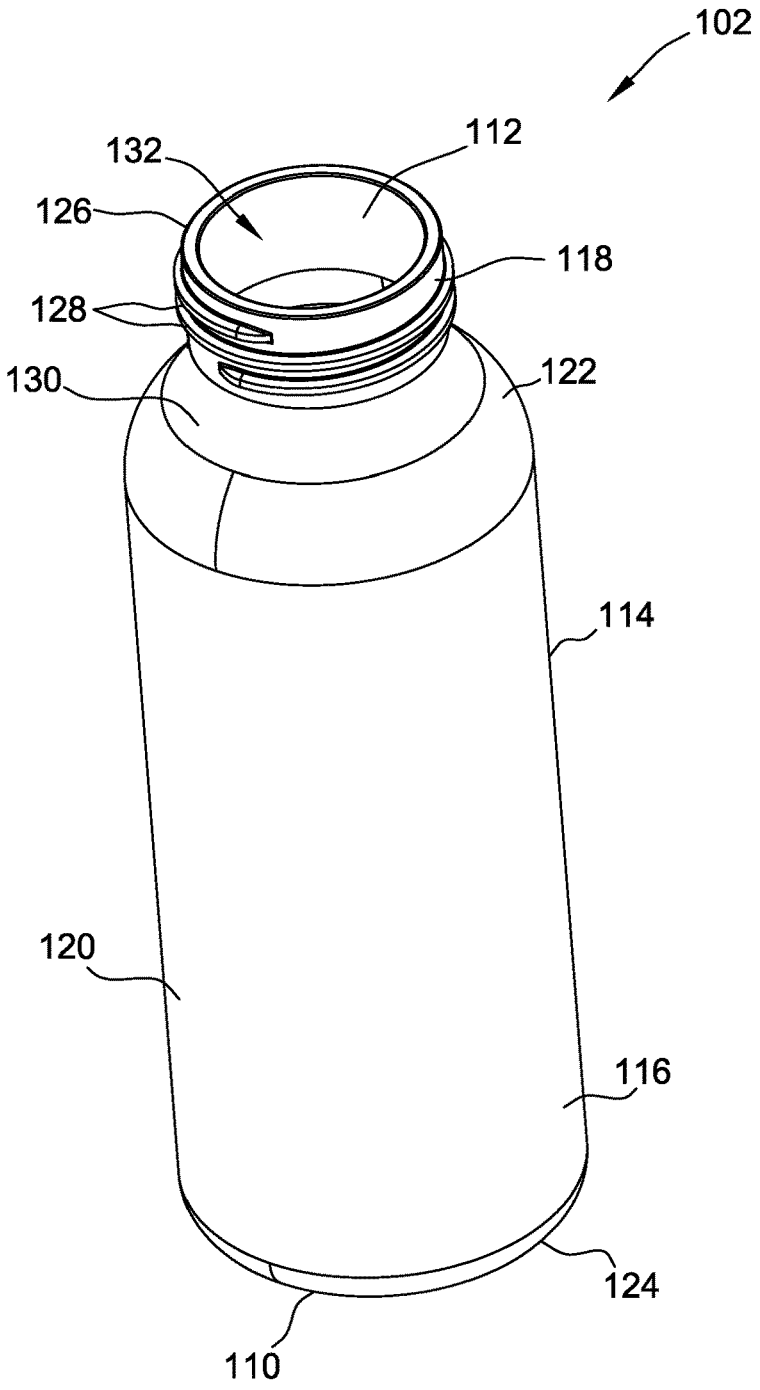
FIG. 3 is a perspective of a container of the nursing bottle assembly of FIG. 1.

With reference to FIGS. 2 and 3, the base portion 116 of the sidewall 114 of the bottle 102 is generally cylindrical and includes a curved lower edge 124 that blends into bottom 110. The top threaded portion 118 of the sidewall 114 is generally cylindrical and has a circular upper edge 126 and external threads 128 spaced below the upper edge 126. In the exemplary embodiment, the top threaded portion 118 of the bottle 102 has a diameter that is less than the diameters of the upper portion 122. As a result of the difference in diameter, the upper portion 122 has a region 130 that tapers toward the top threaded portion 118. The generally cylindrical sidewall 114 extends vertically between the base portion 116 and the upper portion 122. As a result, the generally cylindrical sidewall 114 has a generally tubular shape. It is understood, however, that the diameters of the threaded, upper, middle, and base portions 118, 122, 120, 116, respectively, can be different diameters or sized other than as illustrated herein.

The exemplary bottle 102 has a liquid chamber 132 configured to hold a quantity of liquid for consumption by a user. More specifically, the bottle 102 is configured for use by an infant and to hold approximately 8 ounces of liquid (e.g., milk, formula, water, etc.). The bottle 102 can be fabricated from any suitable material, for example, plastic, glass, stainless steel, aluminum, etc. In addition, the bottle 102 can be fabricated in any desired color or color combinations, and may be transparent, translucent, or opaque. In one suitable embodiment, the bottle 102 is constructed from plastic and manufactured using an injection molding process, which provides greater control over the sidewall thickness of the bottle as compared to a blow molding process. It is understood that the bottle 102 can have different configurations than those illustrated herein, and may be sized to hold quantities of liquid other than 8 ounces (e.g., 2 ounces, 4 ounces, 6 ounces, 12 ounces, etc.).

Figure 4A:
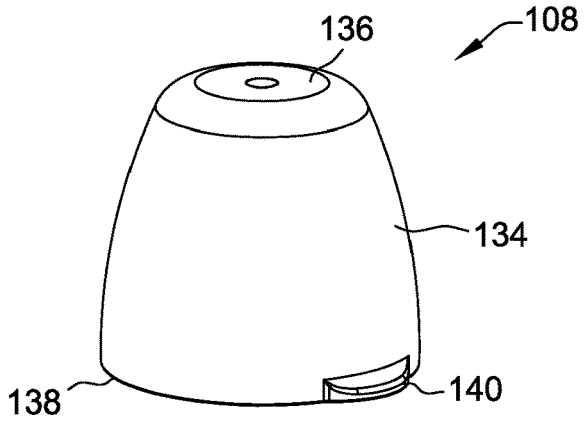
FIGS. 4A and 4B are perspectives of a cover of the nursing bottle assembly of FIG. 1.
Figure 4B:
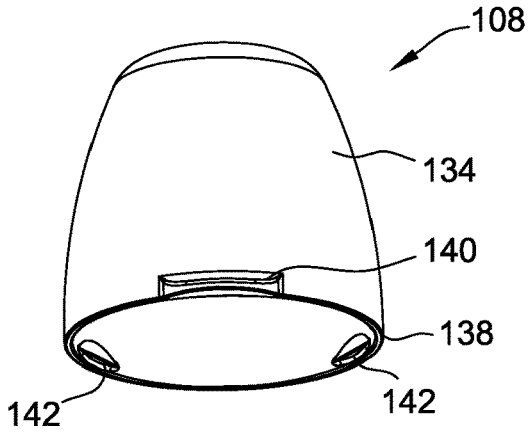
Figure 4C:
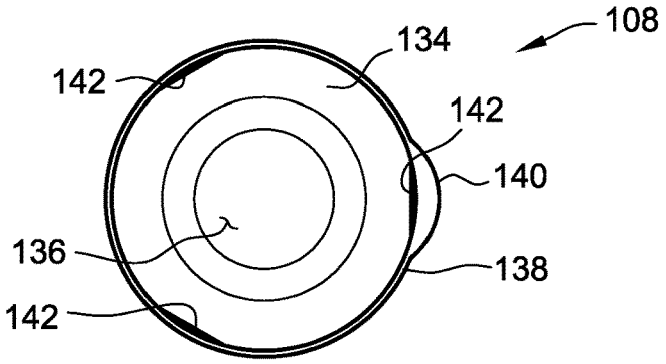
FIG. 4C is a bottom plan view of the cover.

With reference to FIGS. 1 and 2, the cover 108 is removably securable to the collar 104 by a snap-fit connection. It is understood, however, that other types of suitable connections can be used (e.g., a threaded connection). With reference to FIGS. 4A-4C, the cover 108 has a domed body portion 134 and a generally flat top portion 136. The body portion 134 has a lower edge 138 that includes an outward extending semicircular tab 140 configured to facilitate selective removal of the cover 108 from the collar 104. As shown in FIG. 4C, the body portion 134 has three inward extending tabs 142 adapted for releasable snap-fit connection with the collar 104. As a result, the cover 108 can be selectively secured to the collar 104 during periods of non-use of the bottle assembly 100 (e.g., storage, travel, etc.) to cover the nipple 106 (shown in FIGS. 1 and 2), and selectively removed during periods of use of the bottle assembly 100 for providing access to the nipple 106. The three tabs 142 are spaced equidistant about the inner surface of the body portion 134. In the exemplary embodiment, the tab 140 is located opposite one of the three inward extending tabs 142. Alternatively, the tab 140 can be located in any position along the lower edge 138 of the body portion 134 that enables the cover 108 to function as described herein.

The cover 108 can be fabricated from any suitable material, such as polypropylene, and can be made in any desired color or color combinations. In addition, the cover 108 can be transparent, translucent, or opaque. It is contemplated that in some embodiments, the cover 108 may be omitted from the bottle assembly 100. It is understood that the cover 108 can have more or fewer inward extending tabs 142 than the three shown in the exemplary embodiment.

Figure 5A:
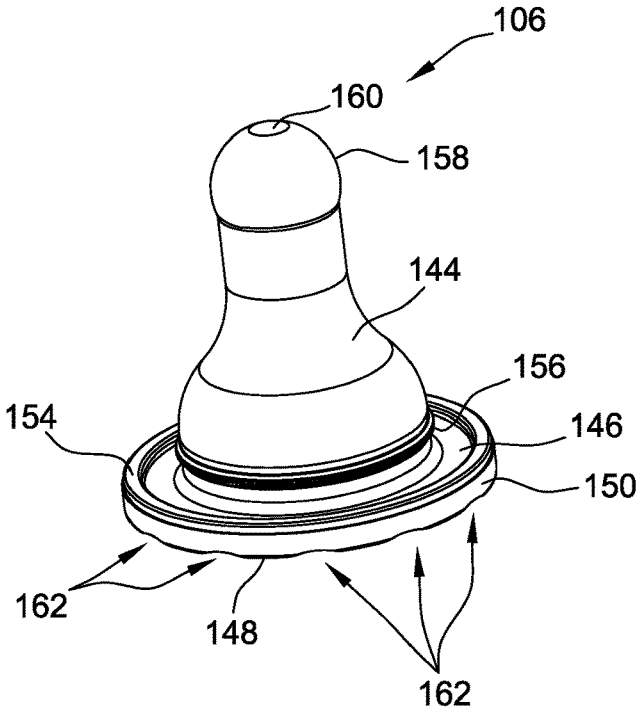
FIGS. 5A and 5B are perspectives of a nipple of the nursing bottle assembly of FIG. 1.
Figure 5B:
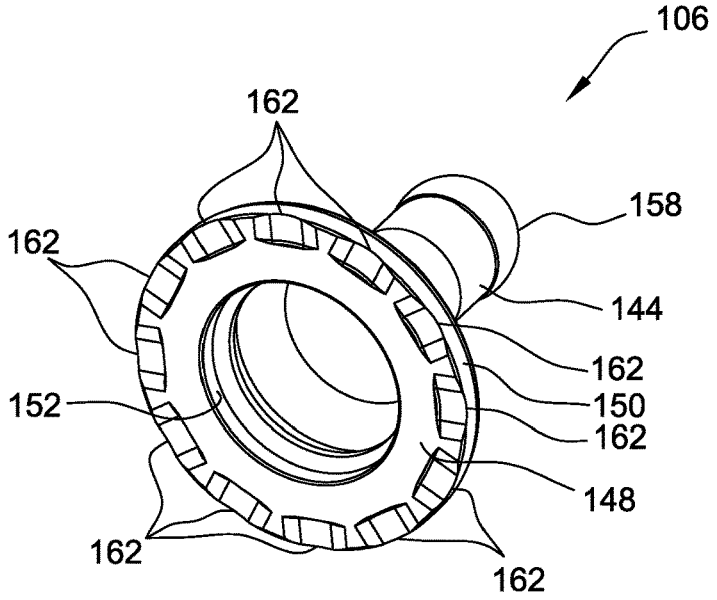

With references to FIGS. 5A and 5B, the nipple 106 includes a nipple portion 144 and a transversely extending flange 146. The nipple flange 146 includes a bottom face 148 that extends from a generally circular outer edge 150 to a generally circular inner edge 152. A peripherally extending lip 154 projects up from the flange 146 generally adjacent the circular outer edge 150. In at least some embodiments, the nipple 106 does not include a peripherally extending lip 154. In the exemplary embodiment, the nipple portion 144 extends up from the flange 146 generally adjacent the circular inner edge 152 thereof. In some embodiments, the nipple portion 144 includes an annular projection 156 that projects radially outward. The nipple portion 144 also includes an outlet end 158 that includes an aperture 160 for dispensing liquid to the user. It is contemplated, however, that the nipple 106 can have different shapes and sizes than those illustrated and described herein without departing from the present invention.

Referring to FIG. 5B, the bottom face 148 of the nipple 106 has a plurality of vent features 162 extending radially inward from the circular outer edge 150 of the flange 146 in equal, circumferentially-spaced relationships to each other. The vent features 162 include a plurality of arcuate (in circumferential extension) channels that extend radially inward from the circular outer edge 150 of the flange 146. It is understood that in other embodiments the vent features 162 may be configured to have any other suitable shape. It is also contemplated that the vent features 162 may instead comprises radially extending slits formed in the bottom face 148 of the nipple 106.

Figure 9:
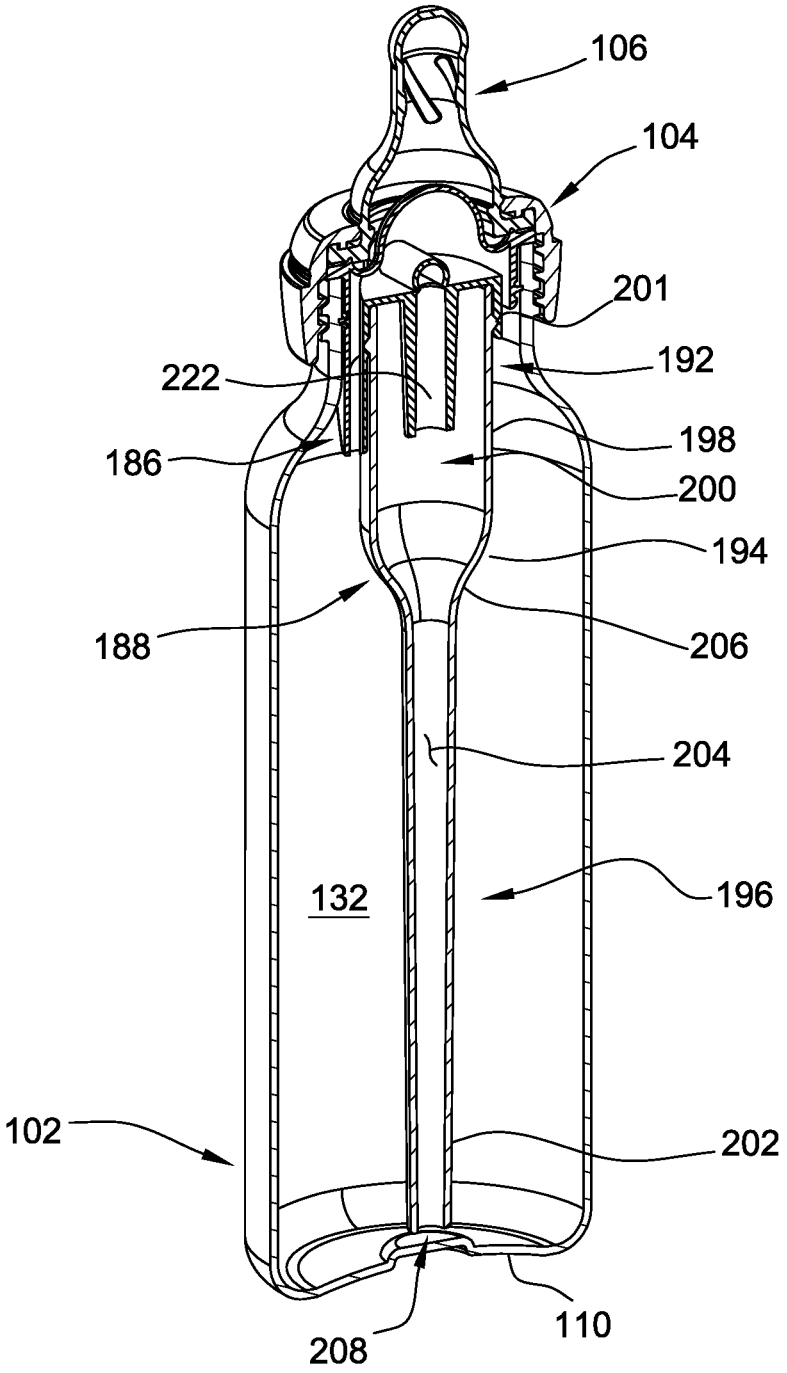
FIG. 9 is a perspective cross-section of the nursing bottle assembly of FIG. 1 in a first configuration including the vent assembly.
Figure 10:
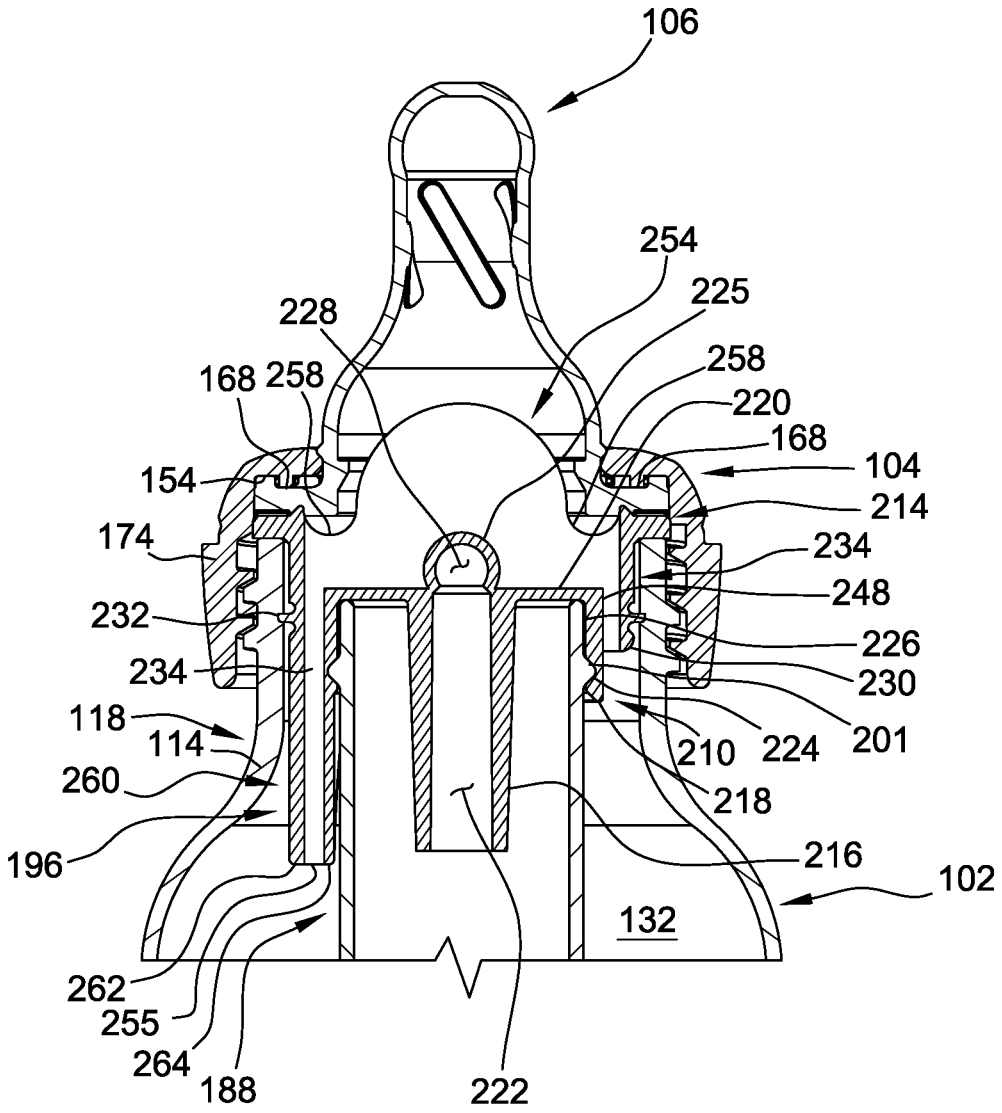
FIG. 10 is an enlarged cross-section of a portion of the nursing bottle assembly of FIG. 1 in the first configuration including the vent assembly.

The vent features 162 are suitably sized in length (e.g., in the radial direction), such that when the nipple 106 is used in the bottle assembly 100 of the embodiment of FIGS. 1 and 2, the vent features 162 do not extend radially inward of the vent insert 186 (described in detail herein) in a first configuration of the bottle assembly 100 (e.g., with the vent assembly 190 in place, as shown in FIGS. 9 and 10) so that the vent insert 186 seals against the bottom face 148 of the nipple 106 radially inward of the vent features 162. However, in a second configuration of the bottle assembly 100 (shown in FIG. 11), the bottom face 148 of the nipple 106 contacts the circular upper edge 126 of the bottle 102 with the vent features 162 extending radially inward of the upper edge 126 of the bottle 102 so that air can enter the bottle 102 via the vent features 162.

The nipple 106 may be fabricated from a substantially pliable material, for example, without limitation, a rubber material, a silicone material, or a latex material. It is contemplated, however, that the nipple 106 may be fabricated from any suitable material without departing from the scope of this disclosure. In the exemplary embodiment, the nipple 106 is suitably transparent or translucent but it is understood that the nipple may instead be opaque.

Figure 6A:
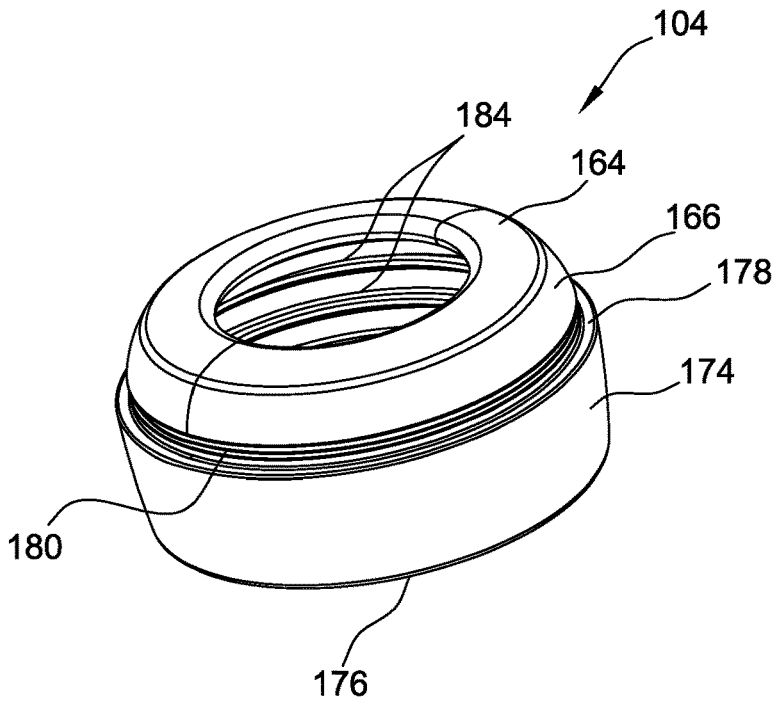
FIG. 6A is a perspective of a collar of the nursing bottle assembly of FIG. 1.
Figure 6B:
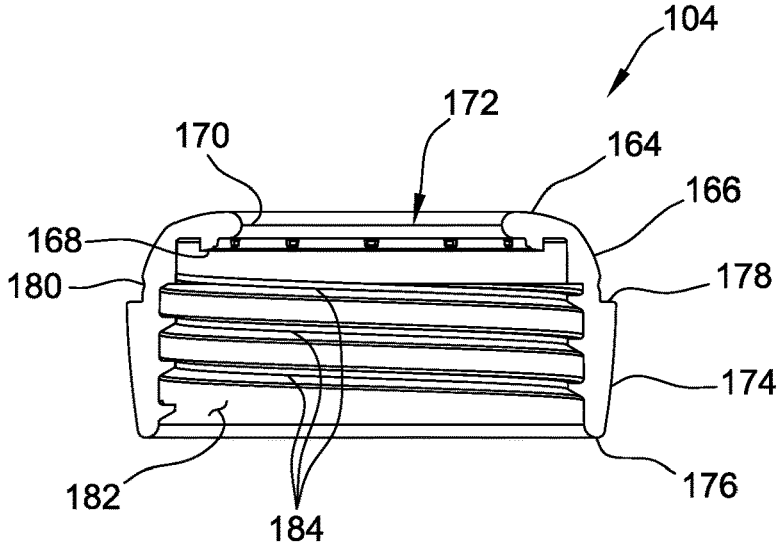
FIG. 6B is a cross-sectional view of the cover.

Referring to FIGS. 6A and 6B, the collar 104 has an annular top panel 164 and an upper convex sidewall 166 depending downward therefrom. The top panel 164 includes an annular projection 168 (as shown in FIG. 6B) that extends downward from the underside of the top panel 164 proximate a radially inner edge margin 170 of the top panel 164. The edge margin 170 and the annular projection 168 facilitate assembly of the nipple 106 (shown in FIGS. 5A and 5B) on the collar 104. To assemble the nipple 106 to the collar 104, the nipple 106 is pulled, nipple portion 144 first, up through a central opening 172 in the top panel 164 of the collar 104 until the edge margin 170 is positioned below the annular projection 156 of the nipple 106, and the annular projection 168 of the collar 104 is positioned radially inward of the peripheral lip 154 of the nipple 106. It is understood, however, that the nipple 106 and collar 104 may be configured other than as illustrated and still otherwise configured for assembly together for further assembly onto the bottle 102. It is also contemplated that in other embodiments the nipple 106 and collar 104 need not be capable of being held in assembly for conjoint assembly onto the bottle 102.

The collar 104 also includes a bottom tapered sidewall 174 that extends upward toward the upper convex sidewall 166 from a bottom edge 176 of the collar 104. The bottom tapered sidewall 174 tapers outward, forming an annular lip 178 where the upper convex sidewall 166 and the bottom tapered sidewall 174 meet. In the exemplary embodiment, the annular lip 178 is located at a generally central location between the bottom edge 176 and the annular top panel 164. The collar 104 includes an annular groove 180 formed in the upper convex sidewall 166 proximate the annular lip 178 for receiving the three inward extending tabs 142 of the cover 108 for releasable snap-fit connection. As a result, the cover 108 can be selectively secured to the collar 104. Furthermore, the collar 104 has an inner surface 182 with suitable internal threads 184 formed thereon for threaded engagement with the external threads 128 of the bottle 102 to releasably secure the collar 104 on the bottle 102. The collar 104 can be fabricated from any suitable material, such as polypropylene, and can be made in any desired color or color combinations. In addition, the collar 104 can be transparent, translucent, or opaque.

Figure 11:
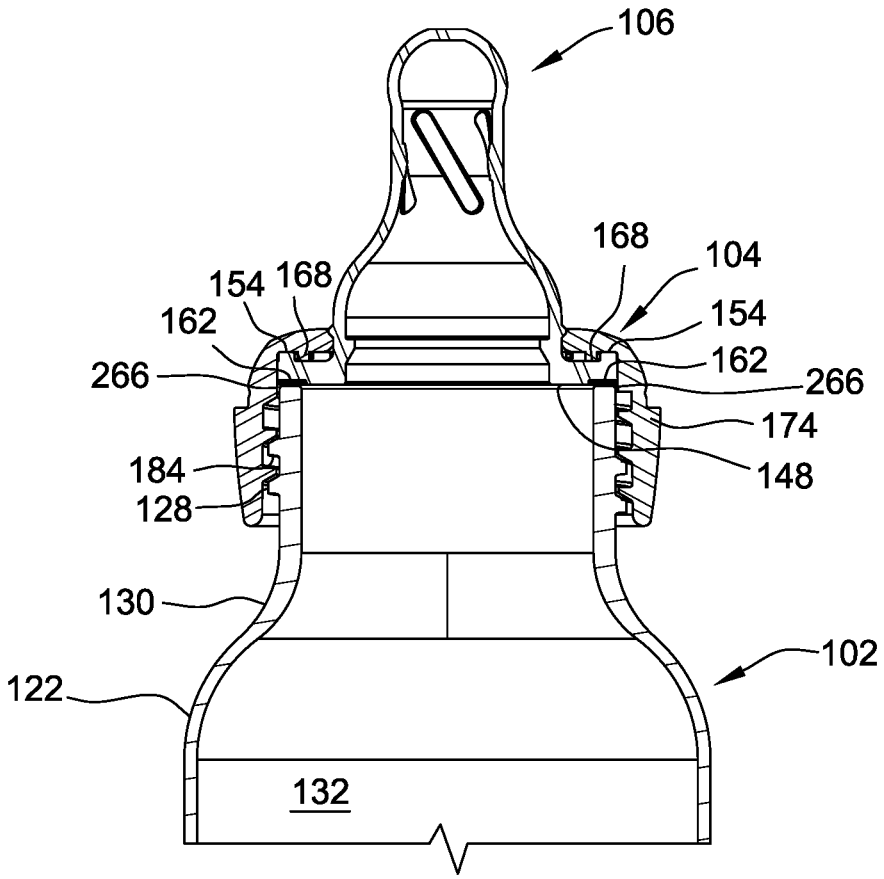
FIG. 11 is an enlarged cross-section of a portion of the nursing bottle assembly of FIG. 1 in a second configuration having the vent assembly omitted.

As shown in FIG. 2, in the first configuration, the bottle assembly 100 includes a vent assembly 190 to facilitate venting of the bottle assembly 100 during use. In FIG. 11, in a second configuration, the vent assembly 190 is omitted. The vent assembly 190 includes a vent insert 186 and a receptacle portion 188. The receptacle portion 188 is releasably attachable to the vent insert 186, such as by friction fit in a manner known in the art.

Figure 7:
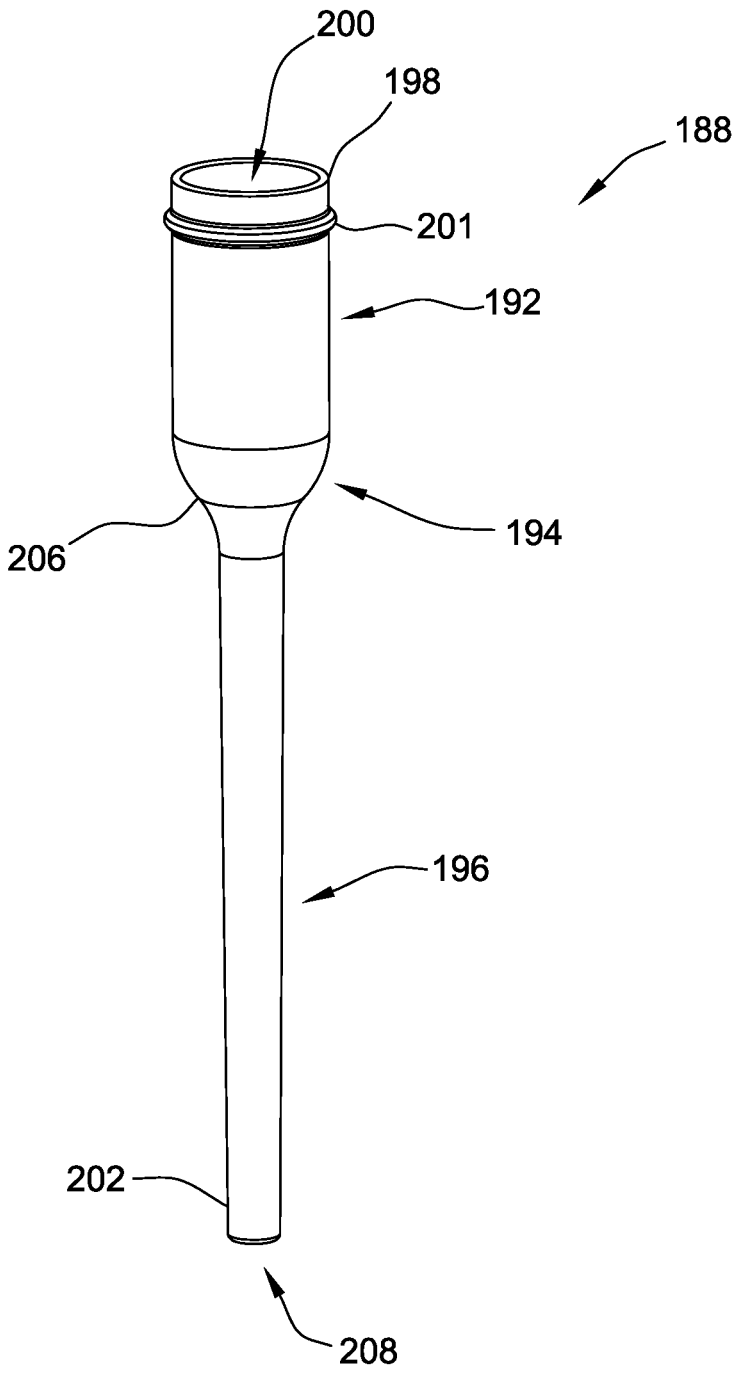
FIG. 7 is a perspective of a receptacle portion of a vent assembly of the nursing bottle assembly of FIG. 1.

With reference to FIGS. 7 and 9, the receptacle portion 188 includes a top portion 192, a middle portion 194, and a vent tube 196. The top portion 192 includes a generally cylindrical sidewall 198 that defines a reservoir 200 therein. In addition, the top portion 192 includes an annular bulge 201 extending around the top portion 192 proximate a top of the receptacle portion 188. The bulge 201 is spaced from the top pf the receptacle portion 188 a predefined distance and configured to engage the vent insert 186. The vent tube 196 includes a generally cylindrical sidewall 202 that has a smaller diameter than the sidewall 198 of the top portion 192. The sidewall 202 of the vent tube 196 defines a passage 204 that is in fluid communication with the reservoir 200. The middle portion 194 includes a tapered sidewall 206 that extends between the vent tube sidewall 202 and the top sidewall 198. The vent tube 196 also includes an air outlet 208 at an end of the passage 204 proximate the closed bottom 110 of the bottle 102.

As shown in FIGS. 8A-8D and 10, the vent insert 186 generally includes an inner portion 210 and an outer portion 214. The inner portion 210 includes a transversely extending top wall 220, an annular sidewall 218 depending (e.g., longitudinally) from the top wall and an internal vent tube 216 also depending from the top wall 220 radially positioned within and more suitably centrally positioned in the annular sidewall 218. The internal vent tube 216 defines an air passage 222 in flow communication with the reservoir 200 (e.g., as seen best in FIG. 9). The depending sidewall 218 includes an annular groove 224 formed on an inner surface 226 thereof. With reference to FIG. 10, to connect the receptacle portion 188 with the vent insert 186, the sidewall 198 of the receptacle is inserted into the vent insert within the sidewall 218 of the inner portion 210 until the bulge 201 of the receptacle portion sidewall 198 seats in the annular groove 224 of the vent insert inner portion sidewall 218.

The outer portion 214 of the vent insert 186 includes an annular flange wall 240 extending transversely of the vent insert and including an inner edge 242, an outer edge 244, a top surface 246 and a bottom surface 248. The bottom surface 248 of the flange wall 240 is configured to sit on the annular rim 126 of the bottle 102 when the bottle assembly 100 is fully assembled, e.g., as shown in FIG. 10. The outer portion 214 of the illustrated vent insert 186 further includes an annular rib 250 projecting up from the top surface 246 of the flange wall 240 adjacent the inner edge 242 thereof for sealing engagement with the nipple 106 upon assembly of the bottle. An annular sidewall 230 depends from the flange wall 240 of the outer portion 214 generally at the inner edge 242 of the flange wall and in radially spaced relationship with the annular sidewall 218 of the inner portion 210. The annular sidewall 230 includes an container engaging bulge or flap 232 extending radially outward from the outer surface of the sidewall 230 for frictionally and sealingly engaging the inner surface of the sidewall 114 of the bottle 102 (more particularly, an inner surface of the threaded portion 118 of the bottle 102) when the vent insert 186 is seated on the bottle 102.

The radially spaced relationship between the annular sidewall 230 of the outer portion 214 of the vent insert 186 and the annular sidewall 218 of the inner portion 210 of the vent insert defines an opening or gap 234 (see, e.g., FIG. 8D) therebetween through which the liquid contents of the bottle 102 can flow past the vent insert 186 into the nipple 106 during feeding, and from the nipple back into the bottle when feeding is stopped. The inner portion 210 of the vent insert 186 is held in assembly with the outer portion 214 at least in part by a transverse vent tube 225 defining a transversely extending vent. The vent tube 225 extends across the upper surface of the top wall 220 of the inner portion and bridges the gap 234 at both ends thereof to attach to the annular sidewall 230 of the outer portion. Openings in the sidewall 230 allow the transverse vent 228 to be in fluid communication with ambient environment exterior of the bottle assembly. The transverse vent 228 is also open to the air passage 222 of the inner vent tube 216 to thereby provide fluid communication of the interior of the bottle with exterior of the bottle assembly via the reservoir 200, inner vent tube air passage 222 and the transverse vent 228. One or more radially extending grooves 252 (FIGS. 8B and 8C) are formed in the bottom surface 248 of the flange wall 240 from the outer edge 244 to the inner edge 242 to complete the fluid communication between the exterior of the bottle and the transverse vent 228. In such embodiments, the grooves 252 facilitate spacing a portion of the vent insert 186 from the rim 126 of the bottle 102 to facilitate air flow to the transverse vent 228 when the outer portion 214 is pressed against the rim 126.

Figure 8A:
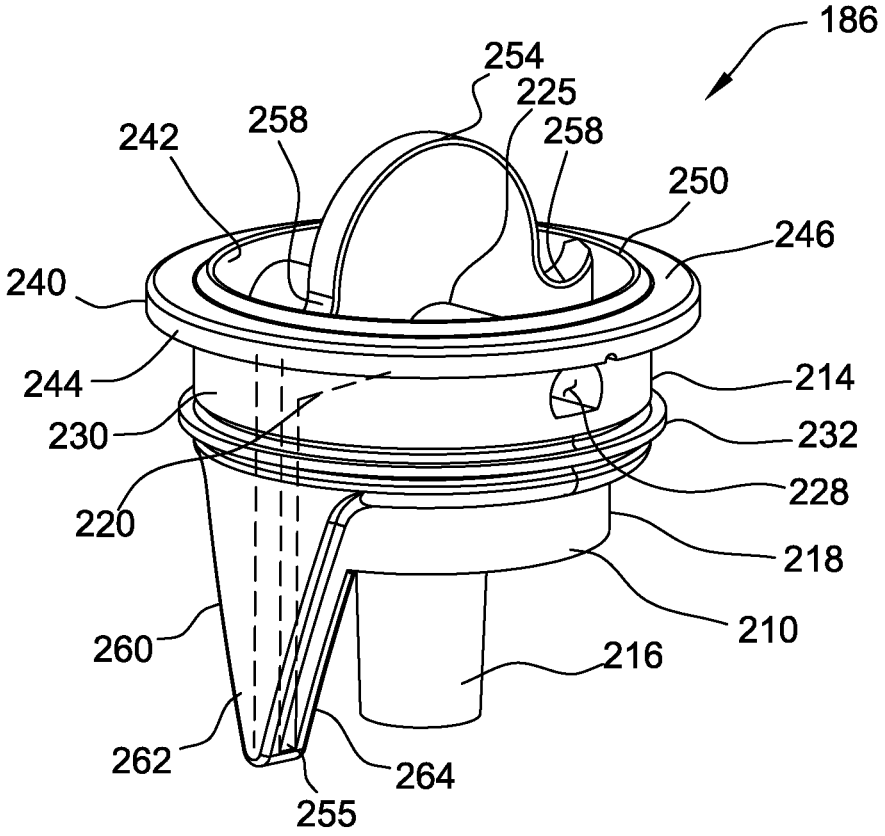
FIGS. 8A and 8B are perspectives of a vent insert of the nursing bottle assembly of FIG. 1.
Figure 8B:
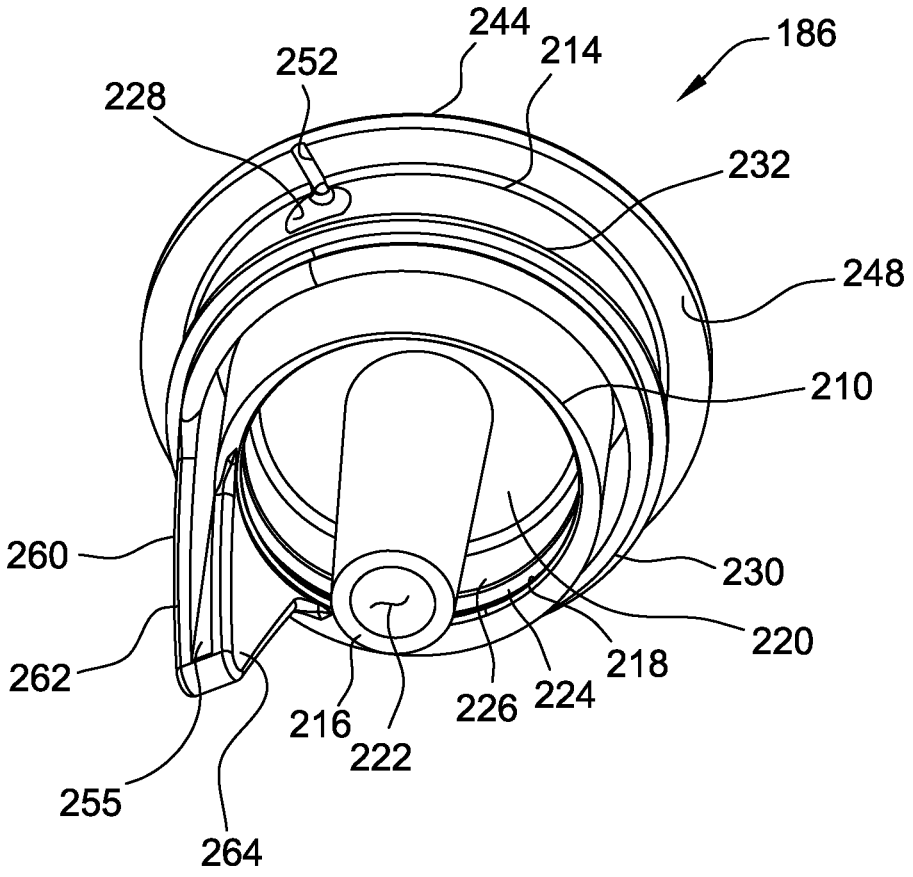
Figure 8C:
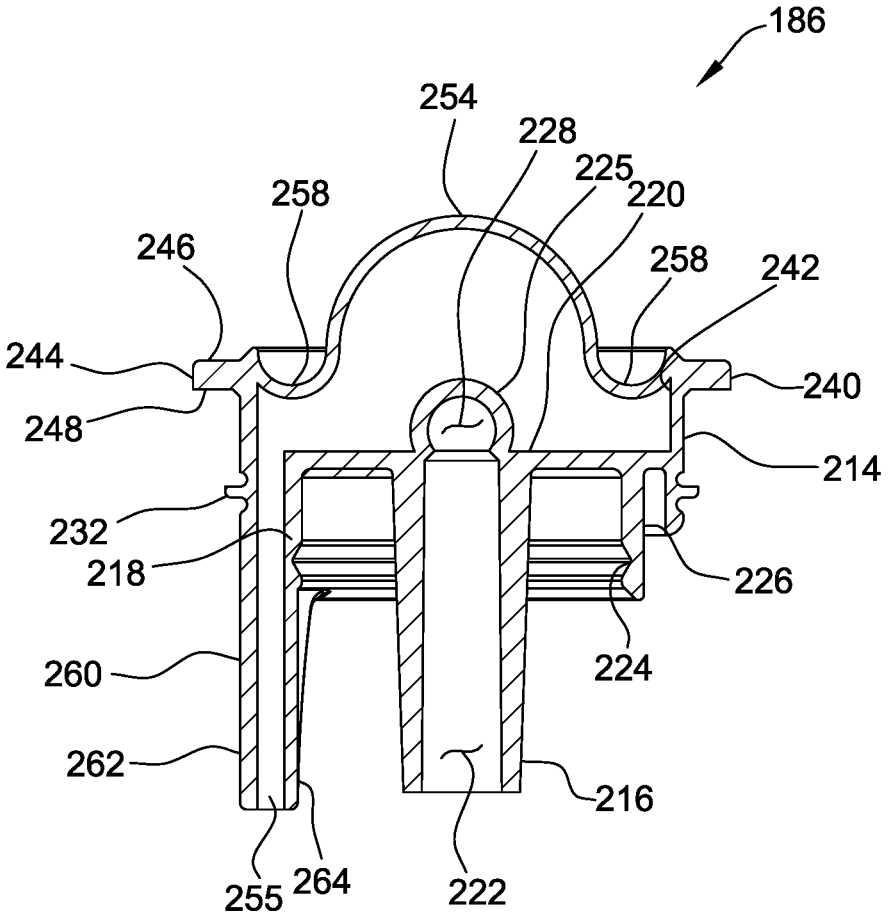
FIG. 8C is a cross-sectional view of the vent insert.
Figure 8D:
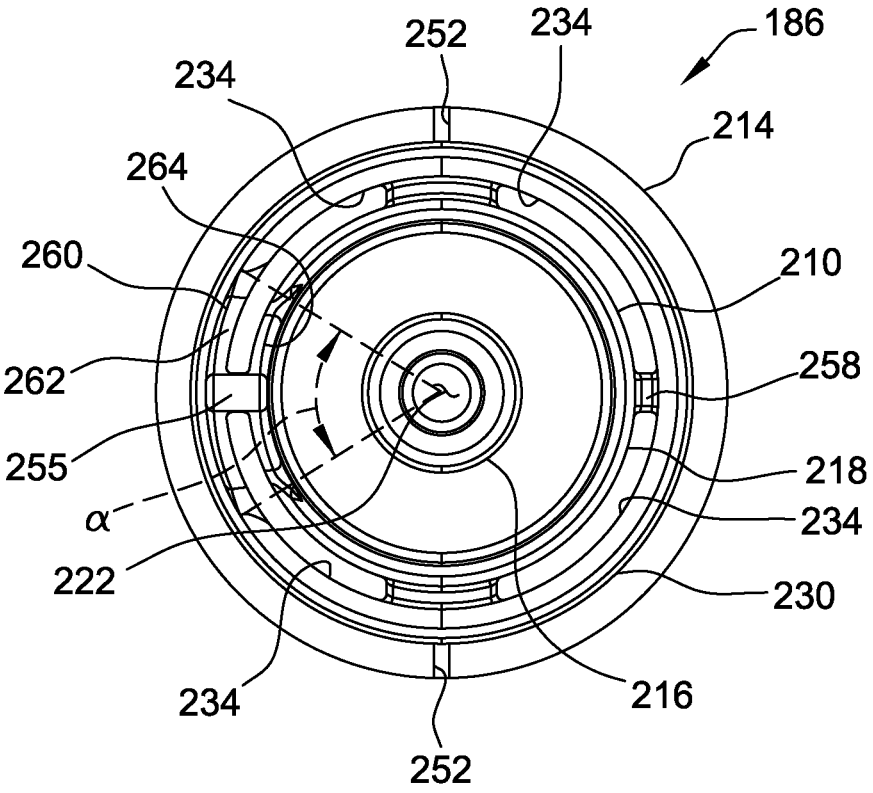
FIG. 8D is a bottom plan view of the vent insert.

In the illustrated embodiment, the vent insert 186 further includes an upstanding grip tab 254 extending up from the top wall 220 of the inner portion 210 of the vent insert to facilitate ease of and disassembly of the vent insert 186 on or off of the the bottle 102. As seen in FIGS. 8C and 8D, in the illustrated embodiment web portions 258 of the grip tab 254 (e.g., at both transverse ends thereof) span the gap 234 between the annular sidewall 230 of the outer portion 214 of the vent insert 186 and the annular sidewall 218 of the inner portion 210 of the vent insert to further connect the inner portion 210 of the vent insert with the outer portion 214 thereof. The webs 258 extending longitudinally downward between the outer portion sidewall 230 and the inner portion sidewall 218 to generally near the bottom of the top wall 220 of the inner portion 210 of the vent insert 186. However, it is understood that in other embodiments the grip tab 254 need not span the gap 234 to remain within the scope of this invention.

To further facilitate the flow of liquid from the nipple 106 back into the bottle 102 when feeding is stopped and the bottle is tilted upright, the vent insert 186 further includes a downward-extending siphon member 260. In the exemplary embodiment, the siphon member extends downward from the top wall 220 of the inner portion of the vent insert 186 into the liquid chamber 132 of the bottle 102 when the vent insert is positioned on the upper edge 126 of the bottle 102. The illustrated siphon member 260 comprises a relatively thin, elongate wall 255 that spans in cross-section radially across the gap 234 between the annular sidewall 230 of the outer portion 214 of the vent insert 186 and the annular sidewall 218 of the inner portion 210 of the vent insert. The elongate wall 255 extends longitudinally generally from adjacent the bottom of the top wall 220 of the inner portion 210 of the vent insert 186 to a position well below the bottom of the annular sidewall 218 of the inner portion vent insert. In the illustrated embodiment the elongate wall 255 extends down to and may even extend beyond the lower end of the inner vent tube 216.

The illustrated siphon member 260 further comprises a pair of support walls, namely, an inner support wall 264 and an outer support wall 262, The elongate wall 255 is attached to and extends transversely between the inner and outer support walls 264, 262. The support walls 264, 262 and the elongate wall 255 are of substantially equal length. In the illustrated embodiment, the inner and outer support walls 264, 262 are of a generally triangular shape, being curved as they extend circumferentially of the vent insert 186 and tapering inward as they extend downward. It is understood that in other embodiments the inner and outer support walls may be other than triangular shaped without departing from the scope of this invention. With reference to FIG. 8D, the siphon member extends circumferentially in an arc $\alpha$ of approximately 60 degrees.

The inner support wall 264 in one embodiment is suitably formed integrally with the annular sidewall 218 of the inner portion 210 of the vent insert 186. The outer support wall 262 in one embodiment is suitably formed integrally with the annular sidewall 230 of the outer portion 214 of the vent insert 186. Additionally, in the illustrated embodiment the elongate wall 255 is formed integrally with one of the webs 258 of the grip tab 254. However, it is understood that the elongate wall may be formed separately from and in spaced relationship with the webs 258 of the grip tab 254 and remain within the scope of this invention. Together, the inner and outer support walls 264, 262 and the elongate wall 255 of the siphon member define elongate, downward extending channels that extend downward away from the gap formed between the inner portion sidewall 218 and outer portion sidewall 230 at the top wall 220 of the inner portion 210 of the vent insert 186. When the bottle is tilted upright after feeding, these channels inhibit liquid from backing up or stagnating in the gap 234 between the inner portion 210 and outer portion 230 and thus facilitate the flow of liquid from the nipple back into the bottle—thus reducing the risk of leakage.

As best illustrated in FIGS. 10 and 11, the collar bottom tapered sidewall 174, the outer portion 214 of the vent insert 186, and the top threaded portion 118 of the bottle 102 are suitably sized relative to each other to facilitate operation of the bottle assembly 100 in two different configurations: the first configuration (as shown in FIG. 10) including the vent assembly 190; and the second configuration (as shown in FIG. 11) in which the vent assembly 190 is omitted. For example, the length (or height in the orientation of the figures herein) of the top threaded portion 118 of the bottle 102 (e.g., from the upper edge 126 of the bottle 102 to the upper portion 122 or the region 130 where the top threaded portion 118 widens outward to the base portion 116 of the bottle 102) is sufficient to accommodate the bottom tapered sidewall 174 of the collar 104 in the second configuration; i.e., when the vent assembly 190 is omitted, as shown in FIG. 11. More particularly, when the vent assembly 190 is omitted, the collar 104 is configured to tighten down an additional vertical distance approximately equal to a height of the perimeter wall 240 of the outer portion 214 of the vent insert 186, such that the bottom face 148 of the nipple 106 seats on the upper edge 126 of the bottle 102. In the second configuration of the bottle assembly 100, because the collar 104 is configured to tighten down the additional vertical distance, the collar 104 securely seats the nipple 106 to the upper edge 126 in order to minimize or eliminate leakage of liquid from the bottle assembly 100 when used without the vent assembly 190.

This may be more readily understood with reference to FIGS. 8A-8D and 10. As shown, the vent insert 186 is constructed such that the height of the outer portion 214 (more specifically, the thickness of the flange wall 240) is relatively narrow compared to the rest of the vent insert 186. This is achieved by, among other features, providing the channel 228 of the transverse vent tube 225 below the outer portion 214 such that the channel 228 (or, alternatively, a majority of the channel 228) ultimately sits below the upper edge 126 of the bottle 102 when the vent insert 186 is in the assembled position (as shown in FIG. 10). Accordingly, the thickness (e.g., height) of the flange wall 240 of the outer portion 214 may be narrower than otherwise would be necessary to accommodate the channel 228 of the transverse vent tube 225 if the channel 228 were provided above the upper edge 126 of the bottle 102 when assembled (as is common for many known vent assemblies). Rather, the flange wall 240 of the vent insert 186 must only be tall enough to accommodate the one or more grooves 252.

Such relative dimensions of the vent insert 190 (i.e., the narrowness of the flange wall 240 relative to the other features of vent insert 186) facilitates assembling the bottle assembly 100 in two discrete configurations, while minimizing leakage from the bottle assembly 100 in each configuration. For example, and as best shown in FIG. 10, in the first configuration, the bottle assembly 100 includes the vent assembly 190. In the first configuration, the vent assembly 190 is inserted into the bottle 102 such that the bottom surface 248 of the flange wall 240 of the vent insert 186 seats down against the upper edge 126 of the bottle 102, and such that the container engaging bulge 232 frictionally and sealingly engages the inner surface of the sidewall 114 of the bottle 102. After the vent assembly 190 is inserted in such a position, the collar 104 is attached to the bottle 102 by threadably engaging the internal collar threads 184 with the external threads 128 of the top threaded portion 118 and rotating the collar 104 to twist the collar down onto the bottle 102. As the collar 104 is tightened onto the bottle 102, the bottom face 148 of the nipple 106 is urged against the top surface 246 of the flange wall 240 and against the annular rib 250 of the vent insert 186 to seal the nipple 106 against the vent assembly 190. Concurrently, the bottom surface 248 of the flange wall 240 of the vent insert 186 is urged against the upper edge 126 of the bottle 102 to position the vent assembly 190 on the bottle 102.

In the first configuration, the collar threads 184 engage the threads 128 of the top threaded portion 118 such that no threads are visible below the collar 104. More particularly, and as shown in FIG. 10, the collar bottom tapered sidewall 174 is sufficiently long such that in the first configuration the bottom edge 176 of the bottom tapered sidewall 174 extends below the lowermost external thread 128 of the top threaded portion 118 so that no external threads 128 are visible when the collar 104 is secured to the bottle 102. Furthermore, because the collar 104 securely seats the nipple 106 and the vent assembly 190 to the upper edge 126 of the bottle 102, fluid leakages are minimized during use of the bottle assembly 100.

Furthermore, in the exemplary embodiment, the annular rib 250 provided on the vent insert 186 serves as a seal between the vent features 162 and the liquid chamber 132 of the bottle 102 such that the vent features 162 are not in fluid communication with the liquid chamber 132 when the bottle assembly 100 is in the first configuration. More particularly, and returning to FIG. 5B, the vent features 162 provided on the bottom face 148 of the nipple flange 146 extend only partially in from the outer edge 150 of the nipple 106 (i.e., the vent features 162 do not extend all the way to an inner edge 152 of the nipple 106). In addition, the annular rib 250 of the vent insert 186 is located (when the bottle assembly 100 is assembled in the first configuration) radially inward of the innermost portion of the vent features 162. Thus, the annular rib 250 seals the liquid chamber 132 of the bottle 102 from the vent features 162, such that the vent features 162 are not in fluid communication with the liquid chamber 132 when the bottle assembly 100 is in the first configuration. Venting of the bottle 102 during use is accomplished via the vent assembly 190, and, more particularly, via the grooves 252 and the transverse vent 228 of the vent insert 186.

In the second configuration, as shown in FIG. 11, the vent assembly 190 is omitted from the bottle assembly 100. In the second configuration, when the collar 104 is tightened down onto the bottle 102, the collar threads 184 engage the threads 128 of the top threaded portion 118 of the bottle 102 and the collar 104 is rotated to twist the collar 104 down onto the bottle 102 until the nipple 106 is urged against the upper edge 126 of the bottle 102 to seal the nipple 106 directly against the bottle 102. Accordingly, the collar 104 will ultimately be twisted a greater distance than in the first configuration before it is fully seated on the bottle 102. That is, because the vent assembly 190 (and accordingly the vent insert 186) is omitted from the bottle assembly 100 in the second configuration, the collar 104 will need to be tightened down an additional vertical distance approximately equal to the height of perimeter wall 240 of the omitted vent insert 186. However, because the vent insert 186 is constructed as described (e.g., because the channel 228 of the transverse vent tube 225 is disposed below the flange wall 240 of the vent insert 186), the flange wall 240 is relatively narrow and thus the collar 104 does not require much additional tightening than when the vent assembly 190 is included (as shown in FIG. 10). Accordingly, in the second configuration, the collar 104 can be fully tightened (i.e., fully assembled such that the nipple 106 securely engages the bottle 102) before the bottom tapered sidewall 174 of the collar 104 engages with the upper portion 122 or the region 130 where the top threaded portion 118 widens outward to the base portion 116 of the bottle 102.

The vent features 162 included on the bottom face 148 of the nipple 106 are configured to vent the bottle 102 when the bottle assembly 100 is in the second configuration, even though the vent assembly 190 is omitted. More particularly, and as best seen in FIG. 11, the vent features 162 space a portion of the nipple 106 apart from the upper edge 126 of the bottle 102 forming vent channels 266 which is in fluid communication with the liquid chamber 132 of the bottle 102. Thus, when the bottle assembly 100 is assembled in the second configuration (i.e., when the bottle assembly 100 is used without the vent assembly 190 and with the nipple 106 compressed against the upper edge 126 of the bottle 102), the bottle assembly 100 nonetheless vents air through the vent channels 266 defined between the vent features 162 and the upper edge 126 of the bottle 102. Thus, even in the second configuration, the formation of a vacuum within the bottle assembly 100 can be reduced or eliminated, as air may fluidly enter the bottle assembly 100 via the vent channels 266.

The components as described herein may provide additional benefits for users of existing bottle assemblies and/or existing vent assemblies. For example, many current users may already own several bottles 102 configured to operate with one or more of the known collar assemblies and/or vent assemblies. These bottles may include, e.g., external threads 128 configured to be used with a known collar assembly and/or a known vent assembly. However, because the flange wall 240 of the vent insert 186 is constructed as described herein (i.e., the flange wall 240 is relatively narrow compared to prior art vent inserts) the bottom tapered sidewall 174 of the collar 104 may be constructed narrower than, e.g., known collars, while still covering the external threads 128 of the bottle 102 when assembled with the vent assembly 190 (as discussed). Accordingly, a user may be able to use the collar 104 and/or the vent assembly 190 described herein with their currently owned containers 102, whereas the upper portion 122 or the region 130 where the top threaded portion 118 widens outward to the base portion 116 of the bottle 102 would otherwise interfere with a known collar (thus leading to leakage) should the known vent assembly be omitted. Furthermore, because some embodiments of the collar 104 of the instant disclosure (and more particularly some embodiments of the nipple 106 of the instant disclosure) include vent features 162 that provide vent channels 266 when the bottle assembly 100 is in the second configuration, the bottle 102 may be vented during use even if the vent assembly 190 is omitted. Thus, some embodiments of the instant disclosure reduce or eliminate the formation of a vacuum within the bottle assembly 100 during use even if the vent assembly 190 is omitted. Still further, a manufacturer or the like of the containers 102 may continue to manufacture the containers 102 using a same design as for known bottle assemblies, while providing the bottle assemblies 100 with the novel collar 104 and/or vent assembly 190 described herein such that the improved bottle assembly 100 reduces or eliminates fluid leakage during use of the bottle assembly 100 in either disclosed configuration.

Exemplary embodiments of an apparatus, system, and methods for a bottle assembly are described above in detail. The apparatus, system, and methods described herein are not limited to the specific embodiments described, but rather, components of apparatus, systems, and/or steps of the methods may be utilized independently and separately from other components and/or steps described herein. For example, the methods may also be used in combination with other bottle apparatuses, systems, and methods, and are not limited to practice with only the apparatuses, systems, and methods described herein. Rather, the exemplary embodiments can be implemented and utilized in connection with many bottle assembly applications.

Although specific features of various embodiments of the disclosure may be shown in some figures and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

As various changes could be made in the above embodiments without departing from the scope of the disclosure, it is intended that all matter contained in the above description and shown in the accompanying figures shall be interpreted as illustrative and not in a limiting sense.

What is claimed is:

1. A feeding assembly comprising:

a container having an open top and defining a liquid chamber therein for holding a liquid;

a collar assembly defining a closure for the open top of the container upon assembly with the container, the collar assembly comprising a collar releasably securable to the container and a nipple coupled to the collar and having an opening through which liquid exits the feeding assembly during feeding; and a vent assembly positionable at least in part on the open top of the container and comprising at least one vent discrete from the nipple opening, the vent assembly being configured to facilitate venting of the container through the at least one vent and other than through the nipple opening to atmosphere as liquid exits the feeding assembly through the nipple opening during feeding, the vent assembly being disposed intermediate the container and the nipple and having at least one opening through which liquid is able to flow from the container to the nipple during feeding, the vent assembly having a siphon member extending longitudinally of the feeding assembly and generally away from the nipple and configured to facilitate the flow of liquid from the nipple back into the container when feeding is ceased and the container is oriented generally upright, wherein the vent assembly has an inner portion and an outer portion, the outer portion being positioned at least in part within the container and engaged therewith upon assembly of the vent assembly with the container, the inner and outer portions of the vent assembly being held in transversely spaced relationship with each other to define said at least one opening through which liquid is able to flow from the container to the nipple during feeding, and wherein the siphon member comprises an elongate wall formed integrally with both the inner portion and the outer portion of the vent assembly and extending between the inner portion and the outer portion of the vent assembly generally at the at least one opening and longitudinally therefrom in a direction away from the nipple when the feeding assembly is fully assembled.

2. The feeding assembly set forth in claim 1, wherein the feeding assembly has a longitudinal axis, the vent assembly having a top wall that extends substantially transverse to the longitudinal axis of the feeding assembly proximate the open top of the container.

3. The feeding assembly set forth in claim 2, wherein the siphon member extends longitudinally from the top wall into the container when the feeding assembly is fully assembled.

4. The feeding assembly set forth in claim 2, wherein the vent assembly further comprises a grip extending at least in part longitudinally outward from the top wall of the vent assembly to facilitate assembly and disassembly of the vent assembly with and from the container.

5. The feeding assembly set forth in claim 1 wherein the elongate wall of the siphon member extends longitudinally within the at least one opening of the vent assembly.

6. The feeding assembly set forth in claim 1 wherein the siphon member further comprises an outer support wall extending longitudinally from the outer portion of the vent assembly and an inner support wall extending longitudinally from the inner portion of the vent assembly in opposed, spaced relationship with the outer support wall, the elongate wall being disposed between the inner and outer support walls along at least part of a length of the elongate wall.

7. The feeding assembly set forth in claim 6, wherein the outer support wall and inner support wall each extends circumferentially of the vent assembly such that the outer support wall, the inner support wall and the elongate wall together define at least one elongate channel extending longitudinally away from the at least one opening of the vent assembly and into the liquid chamber of the container.

8. The feeding assembly set forth in claim 6 wherein the outer support wall and the inner support wall each extends circumferentially of the vent assembly in an arc of approximately 60 degrees.

9. The feeding assembly set forth in claim 6 wherein the outer support wall and the inner support wall are each generally triangular in shape, with each wall tapering inward as it extends away from the at least one opening of the vent assembly.

10. A feeding assembly having a longitudinal axis, comprising:

a container having an open top and defining a liquid chamber therein for holding a liquid;

a collar assembly defining a closure for the open top of the container upon assembly with the container, the collar assembly comprising a collar releasably securable to the container and a nipple coupled to the collar and having an opening through which liquid exits the feeding assembly during feeding; and a vent assembly positionable at least in part on the open top of the container and configured to facilitate venting of the container to atmosphere as liquid exits the feeding assembly during feeding, the vent assembly being disposed intermediate the container and the nipple and having at least one opening through which liquid is able to flow from the container to the nipple during feeding, the vent assembly having a siphon member extending along the longitudinal axis and generally away from the nipple and configured to facilitate the flow of liquid from the nipple back into the container when feeding is ceased and the container is oriented generally upright, wherein the siphon member is generally triangular in shape, tapering inward as it extends longitudinally away from the nipple.

11. A vent insert for use with a feeding assembly, the vent insert comprising:

an inner portion comprising a transversely extending top wall and an annular sidewall depending longitudinally from the top wall;

an outer portion comprising a transversely extending annular flange wall and an annular sidewall depending from the annular flange wall in a radially spaced relationship with the annular sidewall of the inner portion, the annular flange wall including an inner edge, an outer edge, a top surface, and a bottom surface;

a gap defined by the radially spaced relationship between the annular sidewall of the outer portion and the annular sidewall of the inner portion; and a siphon member comprising a longitudinally extending elongate wall that spans the gap between the annular sidewall of the outer portion and the annular sidewall of the inner portion, the elongate wall extending to a position below a lower extent of the annular sidewall of the inner portion.

12. The vent insert as set forth in claim 11 wherein the inner portion further comprises an internal vent tube defining an air passage.

13. The vent insert as set forth in claim 12 further comprising a transverse vent tube located between the inner portion and the outer portion, the vent tube defining a transversely extending vent, the vent defined by the vent tube being in fluid communication with the air passage in the internal vent tube of the inner portion.

14. The vent insert as set forth in claim 11 wherein the siphon member is generally triangular in shape, tapering inward as the siphon member extends longitudinally away from the top wall of the inner portion.

15. The vent insert as set forth in claim 11 wherein the siphon member further comprises an outer support wall extending longitudinally from the outer portion and an inner support wall extending longitudinally from the inner portion in opposed, spaced relationship with the outer support wall, the elongate wall being disposed between the inner and outer support walls along at least part of a length of the elongate wall.

16. The vent insert set forth in claim 15, wherein the outer support wall and inner support wall each extends circumferentially such that the outer support wall, the inner support wall and the elongate wall together define at least one elongate channel extending longitudinally away from the top wall of the inner portion.

17. The vent insert set forth in claim 16 wherein the outer support wall and the inner support wall each extends circumferentially in an arc of approximately 60 degrees.

* * * * *